United States Patent [19]

Arentsen

[11] Patent Number: 4,701,077

[45] Date of Patent: Oct. 20, 1987

[54] APPARATUS FOR WITHDRAWING A TUBE OR PILE WHICH HAS BEEN DRIVEN INTO THE SOIL

[75] Inventor: Dik Arentsen, Leiderdorp, Netherlands

[73] Assignee: IHC Holland N.V., Papendrecht, Netherlands

[21] Appl. No.: 866,957

[22] Filed: May 27, 1986

[30] Foreign Application Priority Data

Jun. 3, 1985 [NL] Netherlands ..... 8501597

[51] Int. Cl.[4] ..... E02D 7/06

[52] U.S. Cl. ..... 405/232; 173/91; 405/228; 405/246

[58] Field of Search ..... 405/246, 228, 232, 274, 405/247; 173/91

[56] References Cited

U.S. PATENT DOCUMENTS

| | | | |
|---|---|---|---|
| 1,102,652 | 7/1914 | Gibb et al. | 173/91 |
| 1,566,631 | 12/1925 | Sturtevant | 173/91 |
| 2,752,889 | 7/1956 | Leavell | 173/91 |
| 2,942,427 | 6/1960 | Berthet et al. | 173/91 X |
| 3,583,499 | 6/1971 | Cordes | 173/91 X |
| 3,651,873 | 3/1972 | Uebel et al. | 173/91 X |
| 3,744,576 | 7/1973 | Sudnishnikov et al. | 173/91 |

FOREIGN PATENT DOCUMENTS

| | | | |
|---|---|---|---|
| 329946 | 12/1920 | Fed. Rep. of Germany | 173/91 |
| 562149 | 10/1932 | Fed. Rep. of Germany | 173/91 |
| 2039544 | 4/1971 | Fed. Rep. of Germany . | |
| 2019620 | 11/1971 | Fed. Rep. of Germany | 173/91 |
| 440140 | 12/1935 | United Kingdom . | |
| 918308 | 2/1963 | United Kingdom | 173/91 |
| 1057248 | 2/1967 | United Kingdom . | |

*Primary Examiner*—Dennis L. Taylor
*Attorney, Agent, or Firm*—Young & Thompson

[57] ABSTRACT

Device for withdrawing a pile or the like which has been driven into the soil by a ram device which can perform blows downwardly and upwardly and which in upward direction has a lost-motion connection with the pile, which lost motion for efficient withdrawal is removed by the extension of hydraulic cylinders.

3 Claims, 2 Drawing Figures

APPARATUS FOR WITHDRAWING A TUBE OR PILE WHICH HAS BEEN DRIVEN INTO THE SOIL

The invention relates to apparatus for withdrawing a tube or pile by means of a ram device placed upon the pile and having a housing and a blow mass movable upwardly and downwardly in said housing, which mass strike a blow downwardly upon the pile as well as upwardly against the housing, which housing can be connected with the tube or pile by means of a connection having lost motion.

The apparatus is applied in case tubes or piles or other profiles are driven into the soil, which later on have to be withdrawn. This e.g. happens if one wants to manufacture a concrete pile in the soil according to the system in which primarily a tube is driven into the soil and thereafter concrete is supplied through the tube with simultaneous withdrawal of the tube. Another example in which withdrawal takes place consists in the removal of e.g. pile planking. Said withdrawal may take place with the same device by means of which the driving took place in case the ram device allows that the ram, instead of moving downwardly with high speed, now can be moved upwardly with sufficient speed and then hits the housing, which subsequently applies an impact tension force on the pile through a connection with the head of the pile. Said tension force serves to assist a tension force which usually is applied with the aid of a hoisting device, which hoisting device, however, directly engages the head of the pile.

During driving in it should be possible that the pile, immediately after the striking of a blow, shoots downwardly from below the housing of the ram device. With a ram device which should be able to ram as well as withdraw it then is necessary that the connection between the housing of the ram device and the upper end of the pile has a free stroke which allows said shooting away or driving down of the pile from below the housing without part of the blow energy getting lost by the fact that the housing again has to be accelerated. However, if one wants to withdraw with such a ram device then with each upward blow first the free stroke has to be passed before blow force can be exerted upon the upper end of the pile in upward direction. This does cost a lot of energy.

Purpose of the invention is to provide a simple solution for this and this purpose is achieved in that prior to the withdrawal the lost motion is removed.

In this way loss of energy during withdrawal is avoided.

With a ram device comprising a housing with a ram movable upwardly and downwardly in said housing, means for moving said ram and means on the housing of the ram as well as means on the outer side of the tube or pile which with the before mentioned means form a connection with lost motion the aim according to the invention can be achieved in a simple way in that the housing of the ram device has been provided with a plurality of downwardly shiftable pressure members which are regularly distributed around the axis of the housing and may engage the pile head or cap. The extendable pressure members remove the clearance. This shifting outwardly can be performed mechanically in any suitable way.

Thus according to the invention it it possible that the pressure members are formed by plungers of hydraulic cylinders.

Said hydraulic cylinders may have a separate pressure supply. If a hydraulic ram device is used according to the invention it makes sense to shift the plungers outwardly by means of the hydraulic pressure members by pressurizing said members when the hydraulic system for controlling the movements of the ram is switched over to withdrawing.

The invention now will be further elucidated with reference to the drawings.

Figure 1:
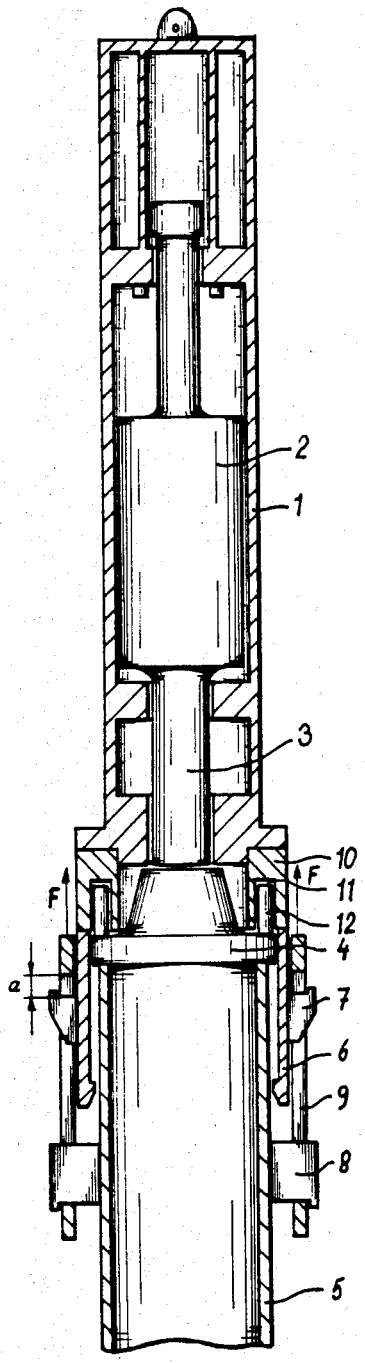
FIG. 1 shows a device according to the invention in the position for driving.

The figures show a housing 1 of the ram device containing a ram 2 which has an extension 3 which can strike the plate 4 which is present on top of a tubular pile 5. The ram 2, 3 is moved upwardly and eventually also downwardly by means of preferably hydraulic means not shown. The housing has an extension 6 extending downwardly along the pile 5 which extension has been provided with cams 7.

The tubular pile 5 has been provided with lugs 8. Links 9 are placed over the lugs 7 and 8.

FIG. 1 shows that the links 9 have a clearance a, so that during the performance of a downwardly directed driving blow the pile 5 can move downwardly from below the housing of the ram 1 over a maximum distance a.

The housing has an annular portion 10 provided with a ring of cylinders 11 with plungers 12.

Figure 2:
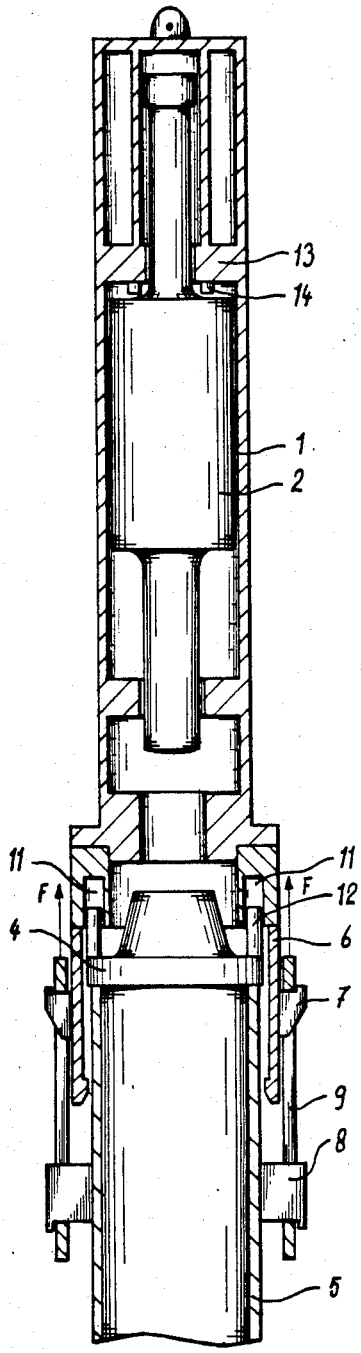
FIG. 2 shows the same device in the position for withdrawing.

If pressure is supplied to said cylinders the plungers 12 will be pressed downwardly into the position shown in FIG. 2 in which case the clearance a is removed.

For the withdrawal the ram 2 is caused to strike the upper part 13 of the housing 1 through the abutments 14. At the same time one may pull with the aid of a hoising device directly on the lugs 8 or by means of the links 9 in a direction indicated with the arrows F.

I claim:

1. In apparatus for withdrawing a tube or pile, comprising a housing with a ram movable upwardly and downwardly in said housing, means for moving said ram and means on the housing of the ram as well as means on the outer side of the tube or pile which with the before mentioned means form a lost-motion connection; the improvement in which the housing of the ram device has a plurality of downwardly shiftable pressure members which are regularly distributed around the axis of the housing and engage a pile head or cap on the pile to take up said lost motion.

2. Apparatus as claimed in claim 1, in which the pressure members are formed by plungers of hydraulic cylinders.

3. Apparatus as claimed in claim 2, in which the ram device is a hydraulic ram device, and the hydraulic pressure members are put under pressure to extend the plungers when the hydraulic system for controlling the movements of the ram is switched over to withdrawing.

* * * * *